US009609955B1

(12) United States Patent
Rogers

(10) Patent No.: US 9,609,955 B1
(45) Date of Patent: Apr. 4, 2017

(54) FOLDABLE BED ASSEMBLY AND METHOD

(71) Applicant: W. Clark Rogers, New London, NC (US)

(72) Inventor: W. Clark Rogers, New London, NC (US)

(73) Assignee: Axess Direct, Inc., Thomasville, NC (US)

( * ) Notice: Subject to any disclaimer, the term of this patent is extended or adjusted under 35 U.S.C. 154(b) by 735 days.

(21) Appl. No.: 13/840,042

(22) Filed: Mar. 15, 2013

Related U.S. Application Data

(60) Provisional application No. 61/645,807, filed on May 11, 2012.

(51) Int. Cl.

| | |
|---|---|
| ***A47C 17/02*** | (2006.01) |
| ***A47C 17/16*** | (2006.01) |
| *A47C 17/04* | (2006.01) |
| *A47C 17/207* | (2006.01) |
| *A47C 17/22* | (2006.01) |
| *A47C 17/14* | (2006.01) |
| *A47C 17/20* | (2006.01) |

(52) U.S. Cl.
CPC ..... *A47C 17/16* (2013.01); *A47C 17/04* (2013.01); *A47C 17/14* (2013.01); *A47C 17/20* (2013.01); *A47C 17/2073* (2013.01); *A47C 17/22* (2013.01)

(58) Field of Classification Search
CPC ..... A47C 17/04; A47C 17/14; A47C 17/16; A47C 17/20; A47C 17/2073; A47C 17/2076; A47C 17/213; A47C 17/22; A47C 17/225
See application file for complete search history.

(56) References Cited

U.S. PATENT DOCUMENTS

| | | | | | |
|---|---|---|---|---|---|
| 1,374,661 | A * | 4/1921 | Hubbert | A47C 17/20 | 5/13 |
| 1,856,449 | A * | 5/1932 | Young | A47C 17/20 | 5/13 |
| 3,283,341 | A * | 11/1966 | Cerchi | A47C 17/138 | 5/13 |
| 3,284,811 | A | 11/1966 | Rogers, Jr. | | |
| 3,298,041 | A | 1/1967 | Rogers, Jr. | | |
| 3,984,883 | A * | 10/1976 | Wong | A47C 17/225 | 5/13 |
| 4,253,205 | A | 3/1981 | Mikos | | 5/13 |
| 4,651,363 | A | 3/1987 | Mizelle | | 5/37 |
| 5,138,727 | A * | 8/1992 | Hanes | A47C 17/225 | 5/13 |

(Continued)

*Primary Examiner* — David E Sosnowski
*Assistant Examiner* — Morgan McClure
(74) *Attorney, Agent, or Firm* — Tuggle Duggins P.A.; Blake Hurt

(57) ABSTRACT

A bed assembly and method of use for connecting a foldable bed frame to the back support of a sofa. The assembly includes a first slotted link attached to the back support and a double slotted link affixed to the foldable bed frame. An L-shaped adjustment link defining a plurality of apertures is slidably connected to the slotted link and pivotably connected to the double slotted link whereby folding the bed frame causes the back support to displace along the first slotted link. Depending on whether the foldable bed frame is being removed from or inserted into the storage cavity within the sofa, the displacement of the back support along the slotted link causes the space between the bed frame and the back support to change.

17 Claims, 10 Drawing Sheets

(56) References Cited

U.S. PATENT DOCUMENTS

| | | | | | |
|---|---|---|---|---|---|
| 5,257,424 | A | * | 11/1993 | Rogers | A47C 27/001 5/13 |
| 5,404,604 | A | | 4/1995 | Has et al. | 5/617 |
| 2008/0098518 | A1 | | 5/2008 | Arft | 5/13 |

* cited by examiner

FOLDABLE BED ASSEMBLY AND METHOD

This non-provisional patent application claims all benefits under 35 U.S.C. §119(e) of U.S. provisional patent application Ser. No. 61/645,807 filed 11 May 2012, entitled "Foldable Bed Assembly and Method", in the United States Patent and Trademark Office, which is incorporated by reference in its entirety herein.

FIELD OF THE INVENTION

The invention herein pertains to a bed assembly and particularly pertains to a foldable bed frame slidably connected to a pivoting back member, such as the back support of a sofa.

DESCRIPTION OF THE PRIOR ART AND OBJECTIVES OF THE INVENTION

Foldable beds are a common solution for those who want a comfortable sleeping space in addition to other furniture but lack the floor space to accommodate additional furniture pieces. Foldable beds, particularly folding beds which are stored within other furniture, are an attractive bedding option for consumers with restricted living space. Unfortunately, by defining a cavity sufficiently large to store a collapsible mattress and foldable bed frame of sufficient size, many pieces of furniture leave large gaps between the back support and the mattress when fully extended. These gaps may facilitate the loss of personal items but they may also serve as a nuisance for children and pets. Therefore, there exits a need for a foldable bed assembly that reduces the space between the sleeping surface and the furniture back support while also providing an efficient and comfortable foldable bed.

Thus, in view of the problems and disadvantages associated with prior art bed assemblies, the present invention was conceived and one of its objectives is to provide a foldable bed frame assembly which effectively reduces the space between the frame and mattress and the back support of the furniture with the storage cavity.

It is another objective of the present invention to provide a collapsible mattress arranged longitudinally on a slidably adjusting foldable bed frame.

It is still another objective of the present invention to provide a foldable bed frame linkage that pivotally attaches a bed frame to the back support of a sofa.

It is yet another objective of the present invention to provide a bed assembly for connecting a foldable bed frame with a double slotted link to a back support with a slotted link.

It is a further objective of the present invention to provide a back support that pivots more vertically when the bed stored within is removed and pivots more horizontally either when the bed is fully extended or returned to storage.

It is still a further objective of the present invention to provide a method of utilizing a foldable bed frame assembly stored within a sofa to reduce the space between a sleeping surface and the sofa.

It is another objective of the present invention to provide a sofa bed with a foldable linkage to minimize the floor space for the extended mattress.

It is still another objective of the present invention to provide a foldable linkage which can be easily assembled and installed during the construction of the sofa bed.

It is yet another objective of the present invention to provide a sofa bed which can be readily extended and folded by a single operator.

It is yet a further objective of the present invention to provide a method of reducing the space between a foldable bed and a back support by providing a linkage assembly including a plurality of links pivotally connected to the bed and back support.

Various other objectives and advantages of the present invention will become apparent to those skilled in the art as a more detailed description is set forth below.

SUMMARY OF THE INVENTION

The aforesaid and other objectives are realized by providing a bed assembly for connecting a foldable bed frame to the back support of a piece of furniture, for example a sofa. The assembly includes a first slotted link attached to the back support and a double slotted link affixed to the foldable bed frame. An L-shaped adjustment link defining a plurality of apertures is slidably connected to the slotted link and pivotably connected to the double slotted link whereby folding the bed frame causes the back support to displace along the first slotted link. Depending on whether the foldable bed frame is being removed from or inserted into the storage cavity within the sofa, the displacement of the back support along the slotted link causes the space between the bed frame and the back support to change.

A method of using a foldable bed stored within a sofa is also included. The method includes the steps of providing a bed assembly with a foldable bed frame attached to a double slotted link, a back support connected to both a first slotted link and an adjustment link, and a base member connected to first and second L-shaped links and a second slotted link, lifting the foldable bed frame out of the sofa, and displacing the back support longitudinally along the first slotted link. The method also includes the steps of extending the foldable bed frame and sliding the foldable bed frame towards the back support, reducing the distance therebetween.

DETAILED DESCRIPTION OF THE PREFERRED EMBODIMENT AND OPERATION OF THE INVENTION

Figure 1:
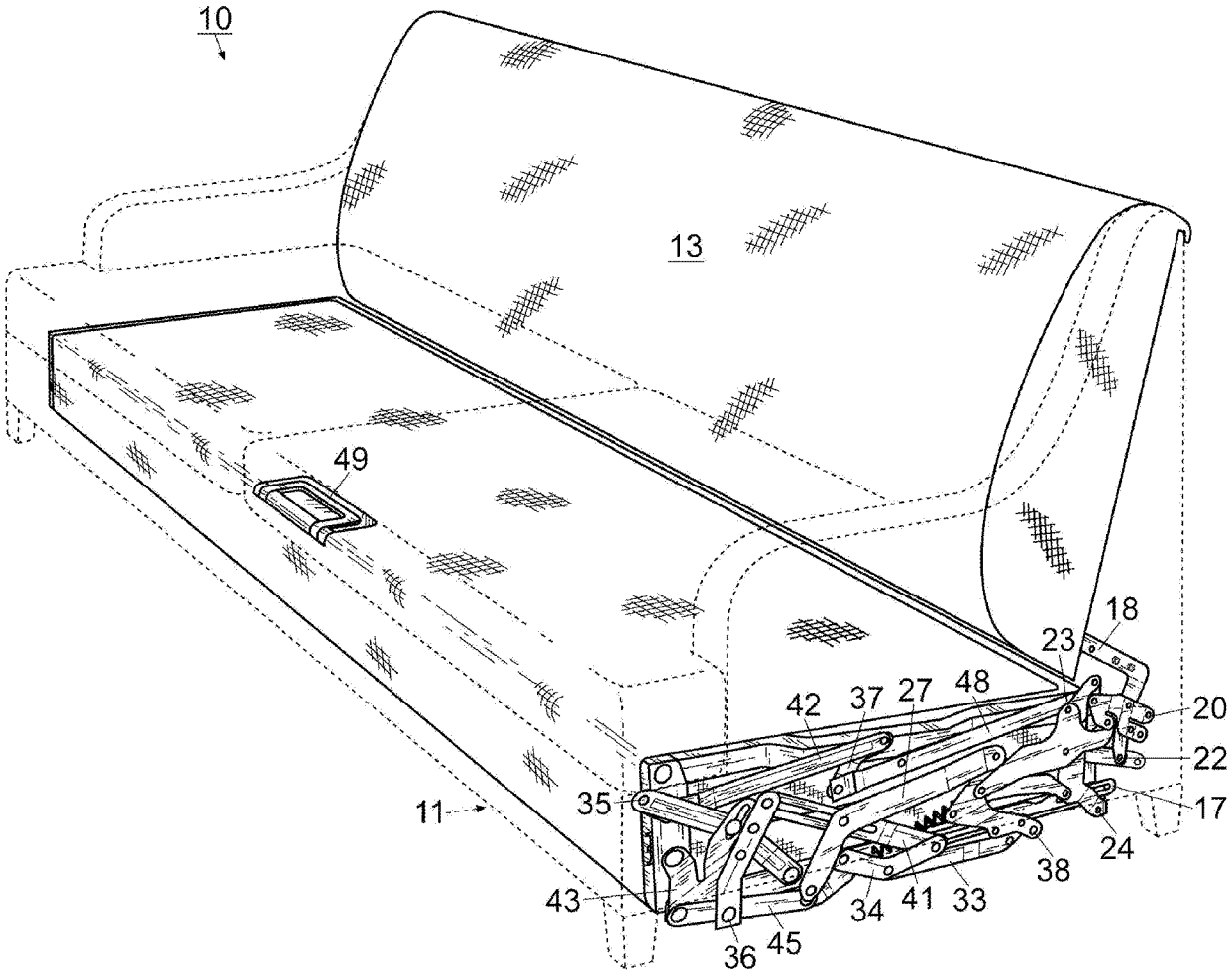
FIG. 1 shows an elevated side perspective view of a retracted foldable bed assembly.
Figure 2:
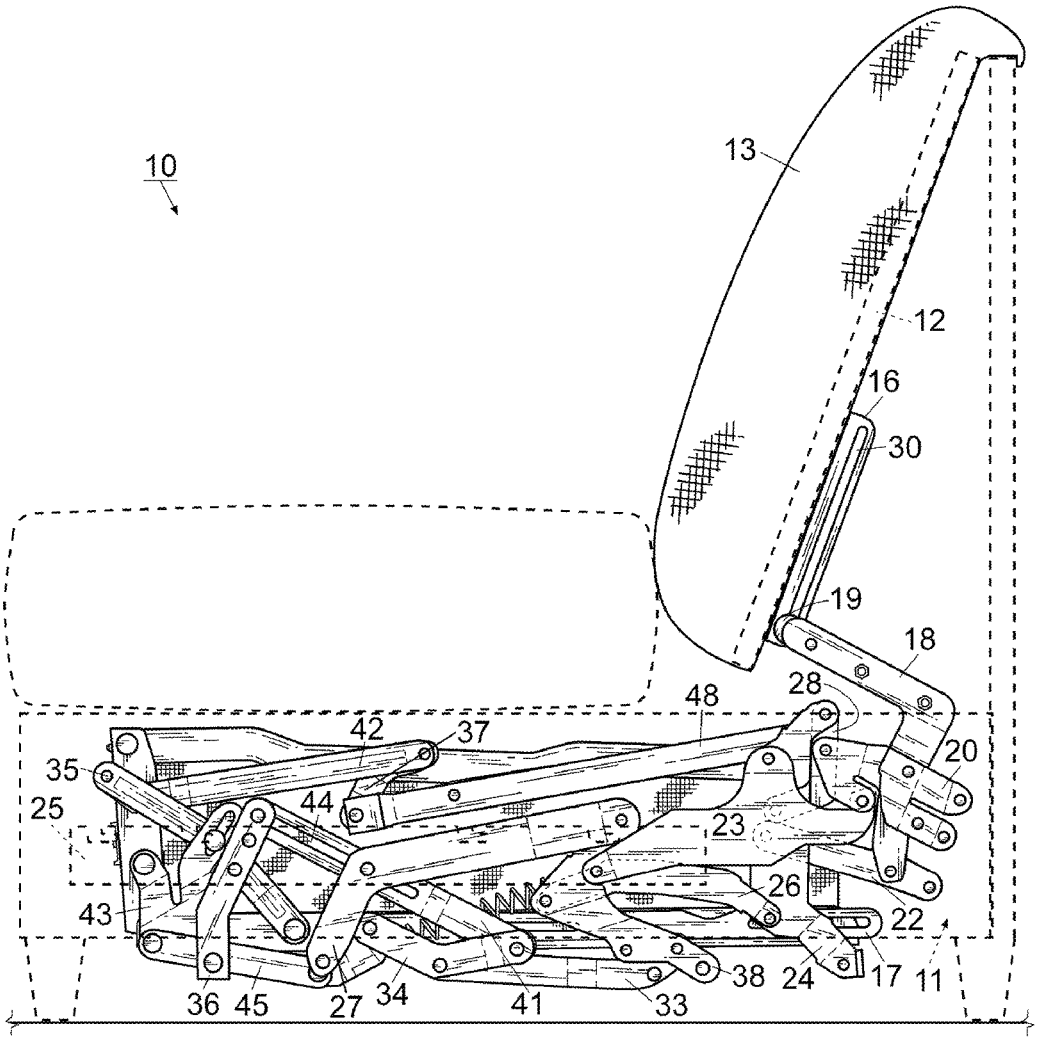
FIG. 2 pictures a side plan view of the foldable bed assembly of FIG. 1.
Figure 3:
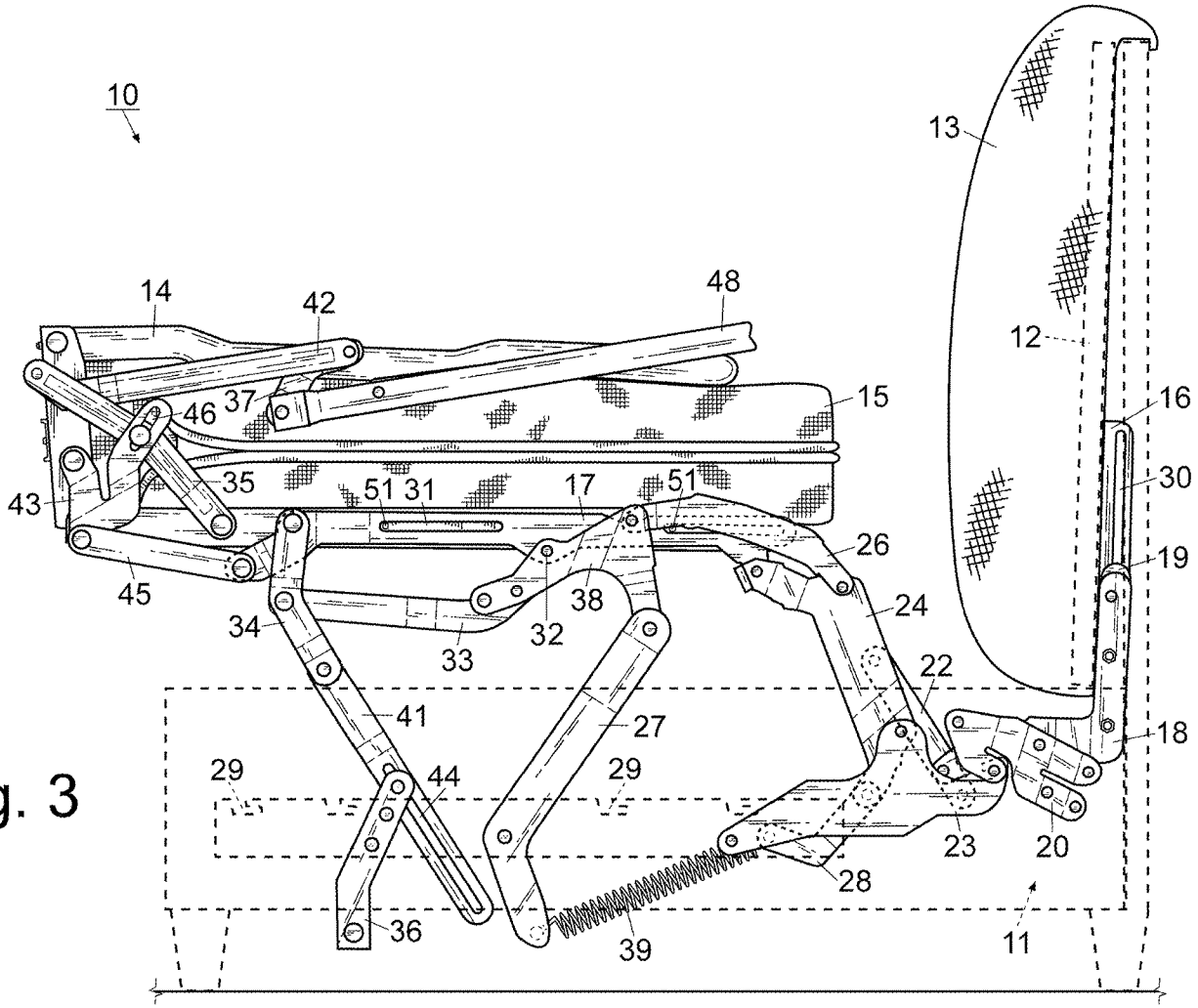
FIG. 3 depicts a side plan view of the foldable bed assembly of FIG. 1 in a partially extended position.
Figure 4:
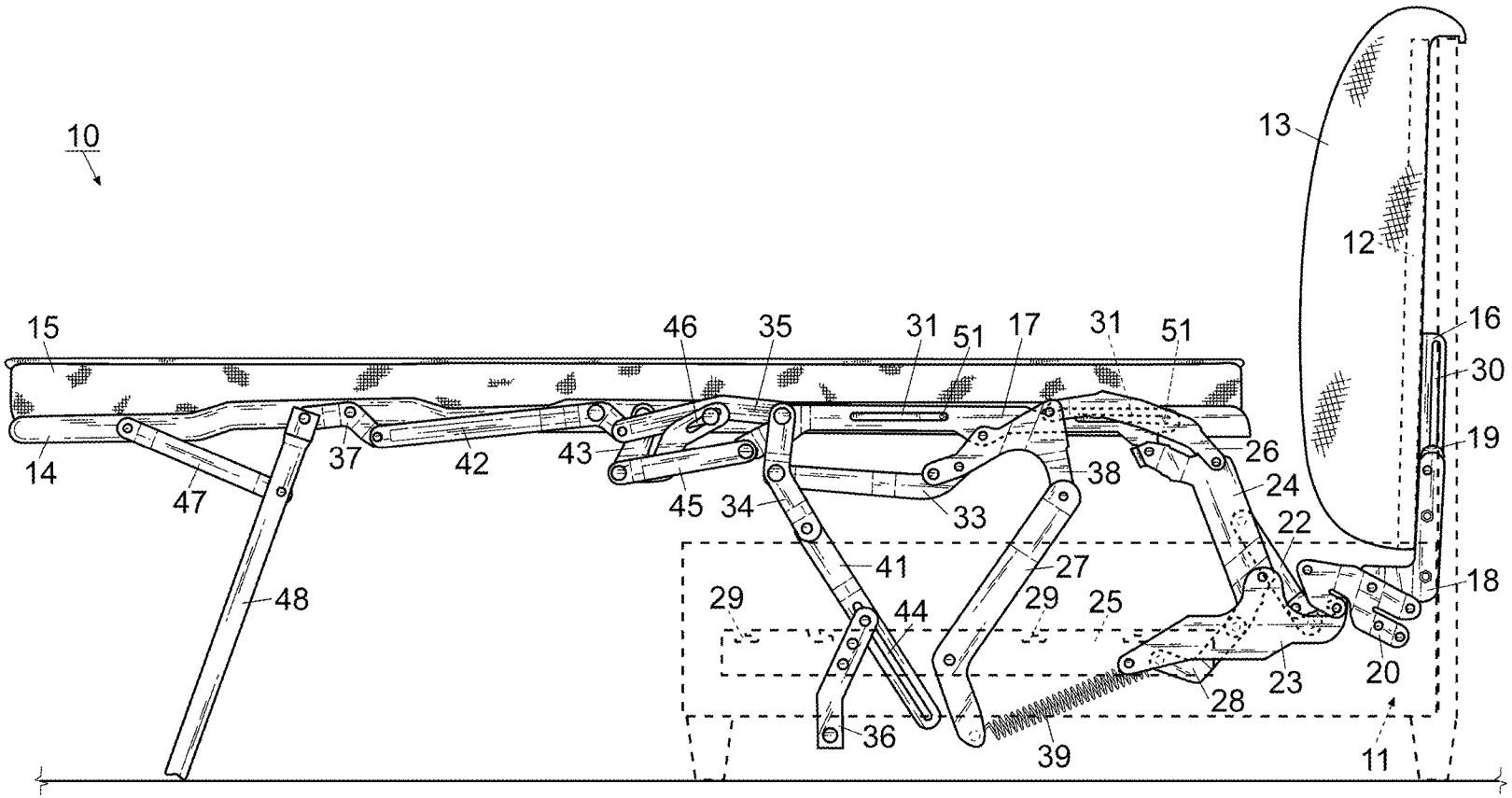
FIG. 4 demonstrates a side plan view of the foldable bed assembly of FIG. 1 in a fully extended position.
Figure 6:
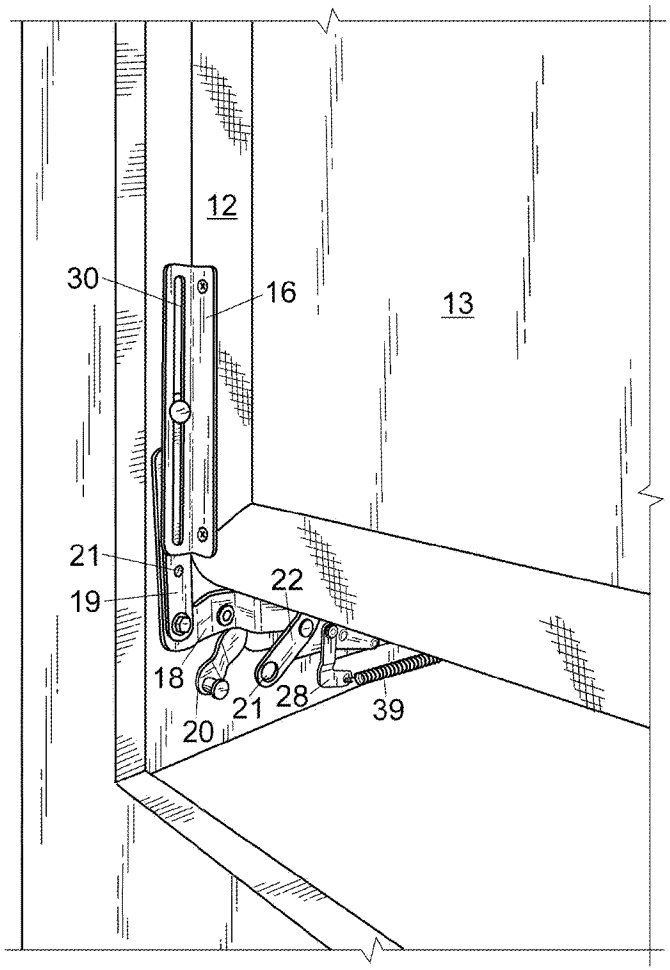
FIG. 6 features a perspective rear view of the foldable bed assembly of FIG. 4.

For a better understanding of the invention and its operation, turning now to the drawings, FIGS. 1-6 show the preferred embodiment of bed assembly 10 in various stages of extension and connected to sofa 11 and bed frame 14 (FIG. 4). Preferred sofa 11 is represented in FIGS. 1-6 as a conventional two cushion couch with back cushion 13 attached to back support but may take the form of a variety of furniture pieces configured to store foldable frame 14 and mattress 15 (FIG. 3) for example love seats, sectional sofas, and chairs. Preferred mattress 15 is a collapsible mattress capable of folding into a low profile although conventional foldable mattresses may be utilized in alternate embodiments. In this context, "low profile" means a mattress capable of folding into a furniture cavity approximately nine inches (22.86 cm) deep, as seen for example in co-pending U.S. patent application Ser. Nos. 13/470,458 and 13/470,478 the entire disclosures of which are hereby incorporated herein by reference.

As would be understood while only one side of bed assembly 10 is shown, a mirror image of the assembly links and members would also be affixed to the opposite side of bed frame 14 in the manner as shown. Many components herein are generally described as having apertures 21 which are not individually marked for clarity within the views and are generally seen as circles (most of which correspond with conventional connection fasteners between respective components).

As displayed throughout FIGS. 1-6 preferred bed assembly 10 consists of first slotted link 16 affixed to back support 12 and a second, double slotted link 17 (FIG. 3) connected to bed frame 14. Preferred first slotted link 16 defines an L-shape and is approximately eight and a half inches (22.35 cm) long, about one inch (2.54 cm) tall, and approximately three quarters of an inch (1.91 cm) wide. First slotted link 16 defines longitudinal slot 30 which is preferably about seven and a half inches (19.05 cm) long and half an inch (1.27 cm) wide, but it is understood that longitudinal slot 30 may be a variety of lengths and widths to receive associated sliding members (see generally FIGS. 5-6), for example a shouldered rivet. First slotted link 16 is affixed to back support 12 (FIGS. 5-6), which can be formed from standard materials such as wood, metal, or polymeric materials, with conventional fasteners, for example screws, bolts or rivets. These fasteners may engage back support 12 through apertures 21 which may be defined on the surface of first slotted link 16 opposite longitudinal slot 30 and may be sized to receive, for example, a conventional wood screw.

Preferred double slotted link 17 defines a C-shaped member that is approximately twenty inches (50.80 cm) long and roughly five inches (12.70 cm) wide. Double slotted link 17 preferably defines a pair of opposing slots 31, 31' which are each approximate one half inch (1.27 cm) wide and about four inches (10.16 cm) long. Slots 31, 31' are for fastening bed frame 14 to double slotted link 17 and permit bed frame 14 to move laterally relative to sofa 11, specifically when mattress 15 is removed from or replaced to storage. Preferred second, double slotted link 17 also defines a plurality of apertures 21 and an anchor point 32 (FIG. 3) which serves as a pivotal attachment point for first U-shaped link 38 and is about five sixteenths of an inch (0.79 cm) in diameter. Anchor point 32 may also serve as the attachment point between double slotted link 17 and bed frame 14 (not shown). Double slotted link 17 also preferably includes an offset of roughly nine sixteenths of an inch (1.43 cm) at one end of the link distal slot 31. This offset may be necessary to properly align double slotted link 17 with the other components of bed assembly 10 in the tight confines of sofa 11.

Bed frame 14 may be a conventional foldable bed frame of tubular construction with handle 49 (FIG. 1) as is known in the art. However, bed frame 14 is preferably oriented longitudinally relative to sofa 11 instead of laterally as is conventional. This positioning of frame 14, in combination with mattress 15, significantly reduces the overall spacial requirement of the traditional sleeper sofa. For example, it is not uncommon for a sofa and foldable mattress to require roughly ninety inches (228.60 cm) from the rear of the sofa to the end of the bed to accommodate laterally unfolded mattress 15. By arranging bed frame 14 and mattress 15 longitudinally, the distance from the rear of sofa 11 to the distal end of mattress 15 may be less than seventy inches (177.80 cm).

As demonstrated more clearly in FIGS. 2-4, first adjustment link 18 preferably defines an L-shape and may be slidably attached to first slotted link 16 with conventional fasteners (not shown) such as screws, bolts, or shoulder rivets. First adjustment link 18 also may define a plurality of apertures 21 extending longitudinally along the planar length of first adjustment link 18. The perpendicular surface of first adjustment link 18 may be divided into three separate sections. The first section is most proximate the planar length portion, is generally planar, and defines an offset approximately two thirds of an inch (1.59 cm). The second section is also planar and defines aperture 21. The third section is arcuately shaped and defines an offset of approximately two thirds of an inch (1.59 cm) in the opposite direction of the first offset such that the terminal sections of this perpendicular surface are generally in the same plane while the middle or second section juts out. The third section also defines aperture 21 towards a distal end relative to the first section.

Figure 5:
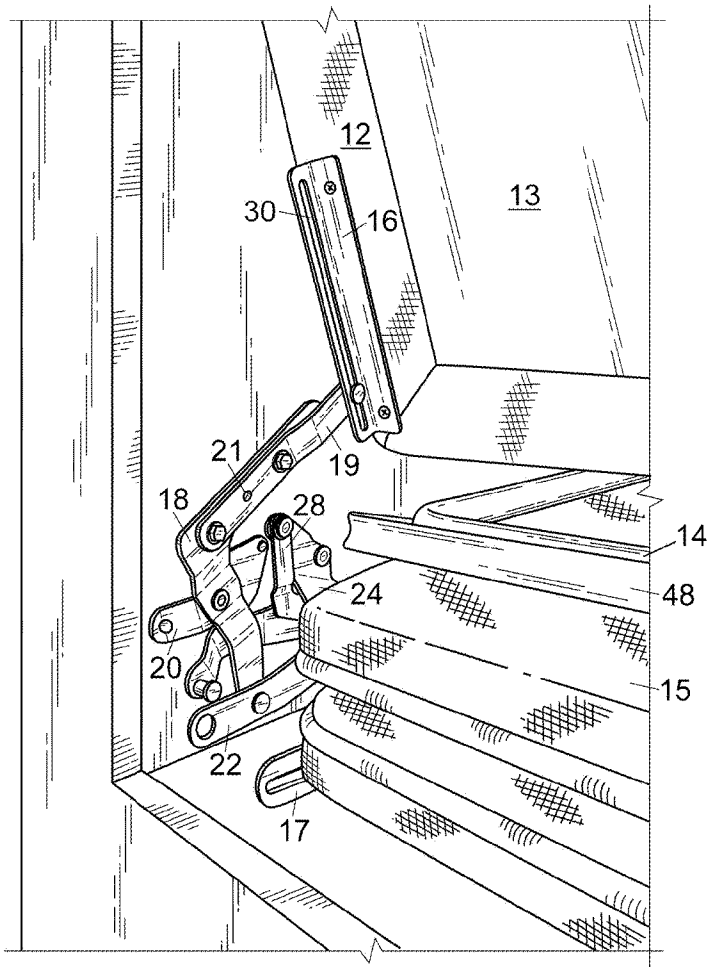
FIG. 5 illustrates a perspective rear view of the foldable bed assembly of FIG. 2.

Preferably, bed assembly 10 also includes second adjustment link 19 which is affixed to first adjustment link 18 and may be slidably attached to link 16. Second adjustment link 19 defines a somewhat planar shape and includes an offset of approximately one quarter of an inch (0.66 cm) as seen in FIG. 5 to allow for spacial compacting of the components of bed assembly 10. Link like first adjustment link 18, defines a plurality of apertures 21 extending in a longitudinal manner which allow for varying the attachment position of first adjustment link 18 to second adjustment link 19. By relying on respective apertures 21 defined by first and second adjustment links 18, 19, bed assembly 10 may accommodate a wide range of sofas 11 and bed frames 14 without major adjustment or cost.

H-shaped link 20 is pictured in FIGS. 2-4. Preferably, H-shaped link 20 is mounted to the frame of sofa 11 and may serve as an attachment point for first adjustment link 18. In the preferred embodiment, H-shaped link 20 is a tri-tiered member with a pointed top portion and one leg portion extending upwardly from a central section approximately seven eighths of an inch (2.22 cm) and one leg portion extending downwardly about one half an inch (1.27 cm) from the central section. H-shaped link 20 also preferably defines a plurality of apertures 21 spaced about the periphery of H-shaped link 20. The tri-tiered orientation of preferred H-shaped link 20 also assists in positioning apertures 21 in the proper position, for example to connect with first adjustment member 18.

Preferred bed assembly 10 further includes first coupling link 23 and first V-shaped link 24 as shown in FIGS. 1-6. First coupling link 23 preferably defines a three-headed shape and a plurality of apertures 21 spaced thereon. One head of first coupling link 23 defines an offset of approximately one sixteenth of an inch (0.16 cm) and terminates in a hook. Another head of first coupling link 23 may define an offset of approximately three eighths of an inch (0.95 cm). This head may also define aperture 21 which preferably serves as a pivotable connection point for first V-shaped link 24. A third head of preferred first coupling link 23 preferably defines an arcuate shape that may be secured to base member 25, which is described in more detail below.

First V-shaped link 24 is preferably approximately nine inches (22.86 cm) in length, one seventh of an inch (0.38 cm) in width and defines a plurality of apertures 21. Preferred V-shaped link 24 also defines a series of lateral offsets. The first offset is about eleven sixteenths of an inch (1.75 cm), the second offset is roughly nine sixteenths of an inch (1.43 cm) and the third offset may be ninety degrees (90°) resulting in a tab perpendicular to first V-shaped link 24 proximate the connection with double slotted link 17 and defining an aperture (not shown). Apertures 21 may serve as pivotable attachment points for double slotted link 17, first arcuate link 26, first planar link 22, first coupling link 23, and second L-shaped link 28, respectively.

Preferred bed assembly 10 also may include base member 25, first L-shaped link 27, and second L-shaped link 28. Base member 25 is preferably approximately 20 inches (50.80 cm) in length, about two inches (5.08 cm) in height, and roughly one ninth of an inch (0.28 cm) wide. Base member 25 (FIG. 4) may further define a plurality of apertures 21 and slots 29. Apertures 21 may serve as attachment points for fifth arcuate link 36, first L-shaped link 27, and coupling link 23. These attachments may be fixed or they may be pivotable connections, depending on the links and the specific configuration of sofa 11. At least one aperture 21 and one slot 29 may also be used to securely fasten base member 25 to sofa 11.

As demonstrated in FIGS. 2-4, first L-shaped link 27 is pivotally affixed to base member 25 and may be pivotally connected to first U-shaped link 38. Second L-shaped link 28 is preferably pivotally attached to V-shaped link 24. Both first and second L-shaped links 27, 28 define apertures 21 proximal the end of their respective shorter legs. These apertures 21 are sized to receive biased member 39 which is presented in FIGS. 1-4 as a spring but may include any resilient member capable of sufficiently biasing first and second L-shaped links 27, 28. First L-shaped link 27 may further define an offset of approximately nine sixteenths of an inch (1.43 cm). Second L-shaped link 28 may define an offset of approximately five sixteenths of an inch (0.79 cm). These respective offsets allow first and second L-shaped links 27, 28 to achieve the correct alignment with respect to other links which with they are connected.

Preferable bed assembly 10 may further include first arcuate link 26, U-shaped link 38, and second arcuate link 33. First arcuate link 26 is preferably approximately seven and a half inches (19.05 cm) in length, roughly one inch (2.54 cm) wide, and about one seventh of an inch (0.38 cm) thick. Preferable first and second arcuate links 26, 33 define a shallow C-shape and a plurality of apertures 21 proximate respective opposite ends. First arcuate link 26 may also define a pair of offsets proximate apertures 21. One offset is approximately one quarter of an inch (0.66 cm) while the other is roughly three sixteenths of an inch (0.48 cm). These offsets serve to align apertures 21 for pivotable attachment to V-shaped link 24 and first U-shaped link 38, respectively. Second arcuate link 33 may also define an offset which is approximately five sixteenths of an inch (0.79 cm) and permits link 33 to pivotably attach with first U-shaped link 38 and third arcuate link 34.

U-shaped link 38 may be approximately six inches (15.24 cm) long, about two inches (2.08 cm) wide, and roughly one seventh of an inch (0.32 cm) thick. U-shaped link 38 preferably defines two offsets, one approximating an eighth of an inch (0.32 cm) and the other about thirteen thirty-seconds of an inch (1.03 cm). First U-shaped link 38 may also define a plurality of apertures 21 positioned around the surface thereof. Preferably, first U-shaped link 38 further defines aperture 21 positioned in a recess located at one end of the link. These offsets cause first U-shaped link 38 to have a bent appearance but they may allow the link to pivotally connect with first arcuate link 26, second arcuate link 33, first L-shaped link 27, and double slotted link 17, respectively.

FIGS. 2-4 also depict preferred bed assembly 10 including third, fourth, and fifth arcuate links 34, 35, 36 and third slotted link 41. Third arcuate link 34 preferably has a length of about five inches (12.70 cm), a width of approximately one inch (2.54 cm), and roughly one seventh of an inch (0.32 cm) thick. Third arcuate link 34 may define a plurality of apertures 21 for pivotable connection to bed frame 14, second arcuate link 33, and third slotted link 41. Preferably third arcuate link 34 may also define a pair of offsets. The first offset is approximately one eighth of an inch (0.32 cm) while the second offset, positioned at the opposite end of link 34, is roughly five sixteenths of an inch (0.79 cm). Preferably fourth arcuate link 35 is six and a half inches (16.51 cm) long, roughly one inch (2.54 cm) wide, and about one seventh of an inch (0.32 cm) thick. Fourth arcuate link 35 may define a plurality of apertures 21 for pivotable attachment to bed frame 14, third L-shaped link 42, and slidably attached to second U-shaped link 43. Preferable arcuate link 35 may further define an offset of about three eighths of an inch (0.95 cm).

Third slotted link 41 preferably defines a length of approximately ten inches (25.40 cm), a width of about one inch (2.54 cm), and a thickness of roughly one seventh of an inch (0.38 cm). Preferred slotted link 41 may also define an offset of approximately three eights of an inch (0.95 cm) and longitudinal slot 44 which extends about five and a half inches (13.97 cm) parallel to the longitudinal axis of the link, in one or more embodiments on the side opposite the offset. Third slotted link 41 is preferably pivotably connected to third arcuate link 34 and slidably attached to fifth arcuate link 36. Preferably fifth arcuate link 36 is roughly five and a half inches (13.97 cm) long, approximately an inch (2.54 cm) wide, and one seventh of an inch (0.32 cm) thick. Fifth arcuate link 36 may define a plurality of apertures 21 for attachment to base member 25, slidable connection to third slotted link 41, and pivotably affixed to horizontal bed support bar, which extends longitudinally below bed sofa 11. Fifth arcuate link 36 may also define a ninety degree bend creating a tab which may further define aperture 21 for securely fastening the link to sofa 11.

As pictured in FIGS. 1-4, bed assembly 10 may further include second U-shaped link 43, third L-shaped link 42, and second planar link 45. Preferred second planar link 45 is approximately four and three quarters inches (12.07 cm) in length, roughly one inch (2.54 cm) in width, and about one seventh of an inch (0.32 cm) thick. Second planar link 45 may define an offset of approximately three sixteenths of an inch (0.48 cm) and may further define a plurality of apertures 21 positioned at opposing ends of the link which assist in pivotably connecting link 45 to double slotted link 17 and second U-shaped link 43.

Second U-shaped link 43 preferably defines a first arm that is approximately four and a half inches (11.43 cm) long and a second arm that is about two inches (5.08 cm) long with both arms about an inch (2.54 cm) wide and one seventh of an inch (0.32 cm) thick. The first arm of second U-shaped link 43 may also define an offset of about three eights of an inch (0.95 cm) and may further define second U-shaped link slot 46. Second U-shaped link slot 46 is preferably one and a half inches (3.81 cm) in length and may be sized to slidably receive a fastener connected to fourth arcuate link 35. The second arm of second U-shaped link 43 may also define an offset measuring approximately five eights of an inch (1.59 cm) and may further define aperture 21 for pivotably connecting with bed frame 14. Second U-shaped link 43 may also define aperture 21 for pivotally connecting to second planar link 45.

Third L-shaped link 42 preferably defines a length of about ten inches (25.40 cm), a width of about one inch (2.54 cm) and a thickness of approximately one seventh of an inch (0.32 cm). Preferably third L-shaped link 42 may define a plurality of apertures 21 to pivotally connect to fourth and sixth arcuate links 35, 37, respectively. Third L-shaped link 42 may also define a pair of five sixteenths of an inch (0.79 cm) offsets positioned in opposing relation near the junction of the long and short legs of the L-shaped link.

As featured in FIGS. 1-6, preferred bed assembly 10 may include sixth arcuate link 37, third planar link 47, and support leg 48. Preferred C-shaped sixth arcuate link 37 defines a plurality of apertures 21 for pivotable attachment to third L-shaped link 42, bed frame 14, and support leg 48. Sixth arcuate link 37 may also define a pair of offsets. The first offset is approximately one quarter of an inch (0.64 cm) while the second offset, positioning in opposing relation on link 37, is three sixteenths of an inch (0.48 cm). Third planar link 47 preferably defines a plurality of apertures 21 for pivotable connection to support leg 48 and bed frame 14. Third planar link 47 may also define a pair of opposing offsets approximately three sixteenths of an inch (0.48 cm). Support leg 48 may be a tubular member for supporting the portion of bed frame 14 and mattress 15 that is distal sofa 11. Support leg 48 also preferably is pivotably mounted to bed frame 14 such that when frame 14 is stored within sofa 11, support leg 48 collapses into a compact storage position as shown in FIGS. 2 and 3.

A method of storing a mattress in a low profile sofa is also provided. By using bed assembly 10, a comparatively large mattress may be deployed in a room with a limited spatial footprint. This method may include the steps of providing bed assembly 10 including foldable bed frame 14 attached to double slotted link 17, back support 12 connected to first slotted link 16 and first adjustment link 18, and base member 25 connected to first coupling link 23, first L-shaped link 27, and fifth arcuate link 36. After the cushions are removed, the method further includes the steps of lifting foldable bed frame 14 out of sofa 11, for example by handle 49, sliding first adjustment link 18 up first slotted link 16, and sliding fifth arcuate link 36 up third slotted link 41. The method may also include the steps of extending first L-shaped link 27 more vertically and pivoting first V-shaped link 24 in a clockwise manner almost one hundred eighty degrees. The method may further include the steps of displacing back support 12 longitudinally along first slotted link 16 such that back cushion 13 pivots out of the path of bed frame 14, pivotally extending the distal portion of bed frame 14, including support leg 48, such that mattress 15 and bed frame 14 are in a substantially horizontal orientation and support leg 48 contacts the ground. The method may further include the steps of providing U-shaped link 43 defining slot 46 which may by in communication with fourth arcuate link 35 such that when bed frame 14 is fully extended, it also slides towards back cushion 13 to reduce the distance created by the pivoting of back support 12.

Figure 7:
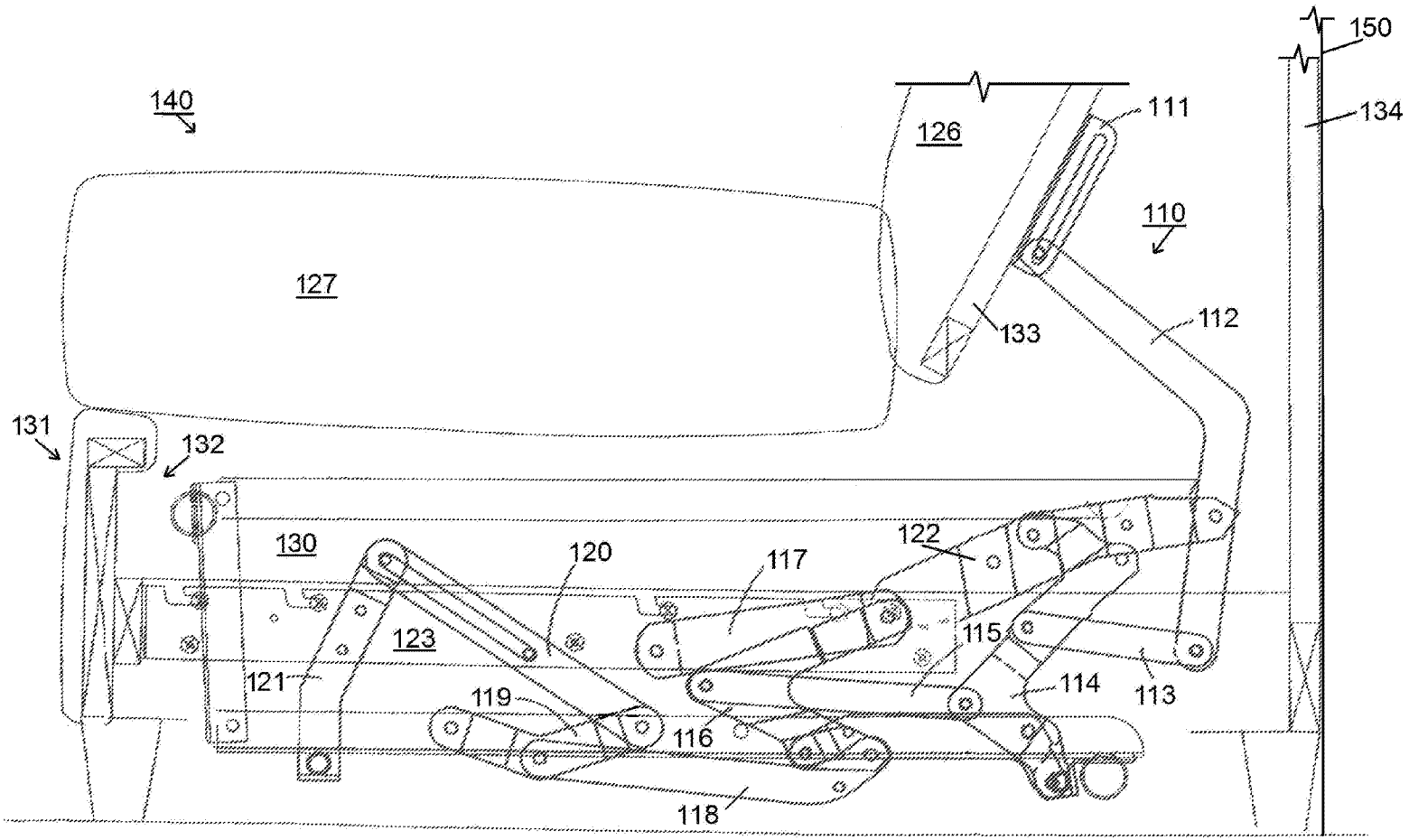
FIG. 7 shows a side plan view of an alternate embodiment of the foldable bed assembly of FIG. 1.

An alternate embodiment of bed assembly 10 is shown in FIGS. 7-12. Foldable bed assembly 140 is shown schematically in FIGS. 7, 9 and 11 with enlarged versions of foldable linkage 110 shown in FIGS. 8, 10 and 12 for clarity. In FIG. 7 a left side elevational view of linkage 110 is shown with mattress 130 in a folded posture contained within sofa cavity 132 with mattress 130 affixed to linkage 110 for seating purposes. Bed assembly 140 further includes headboard 134, sofa frame 131, seat cushion 127 and back cushion 126 affixed to back cushion support 133. As would be understood only one foldable linkage 110 is shown but a mirror image of linkage 110 would be affixed to the right side of mattress 130. Removable seat cushion 127 is shown positioned on sofa frame 131 as mattress 130 remains within cavity 132.

Foldable linkage 110 as shown in FIGS. 7-12 consists of first slotted link 111 affixed to back cushion support 133 with back cushion 126 attached. Slotted link 111 is slideably connected to first arcuate link 112 which is pivotally joined to first planar link 113. Planar link 113 is pivotally connected to Z-shaped link 114 which is pivotally affixed to second planar link 115 and mounting plate extension 122 (shown in FIGS. 9 and 11). Second planar link 115 is connected to V-link 116 which in turn is pivotally joined to second arcuate link 118 and third planar link 117. Second arcuate link 118 is pivotally joined to third arcuate link 119 and also to second slotted link 120 which is slideably attached to fourth arcuate link 121. Mounting plate extension 122, third planar link 117 and fourth arcuate link 121 are each affixed to body section extension 123 which is mounted to sofa frame 131. Mounting plate extension 122 and fourth arcuate link 121 are stationary.

Figure 8:
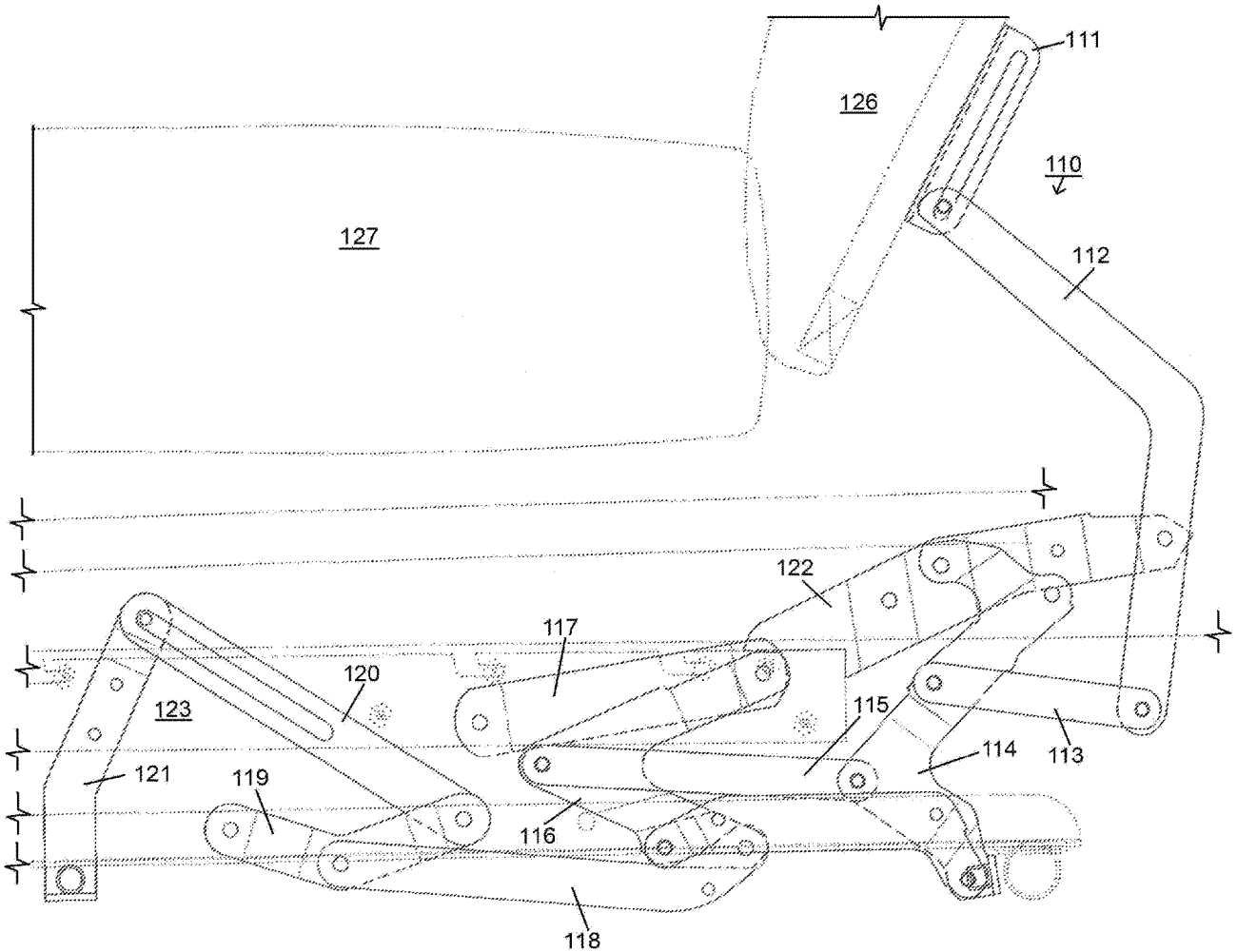
FIG. 8 pictures a magnified side plan view of the foldable bed assembly of FIG. 7.
Figure 9:
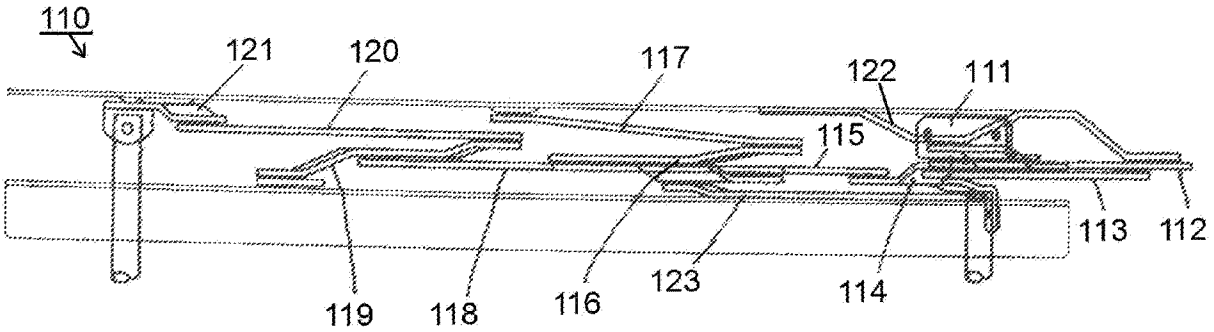
FIG. 9 depicts a top plan view of the foldable bed assembly of FIG. 7.
Figure 10:
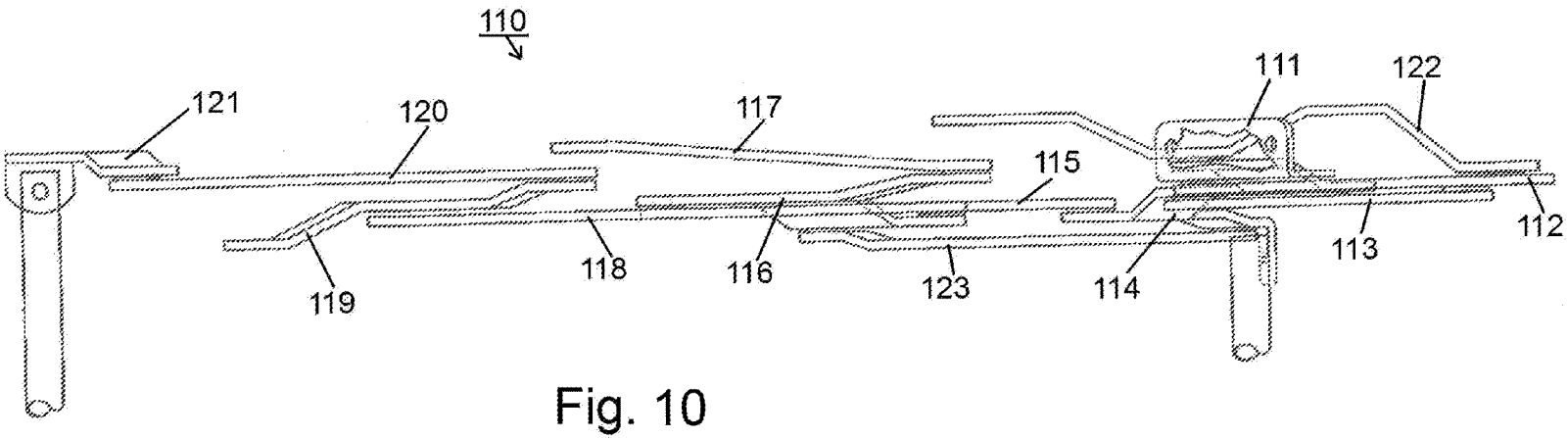
FIG. 10 demonstrates the foldable bed assembly of FIG. 9 in an extended configuration.

In FIG. 9 a top view of foldable linkage 110 as shown in FIG. 7 is seen with enlarged views in FIGS. 8 and 10 providing additional clarity.

Figure 11:
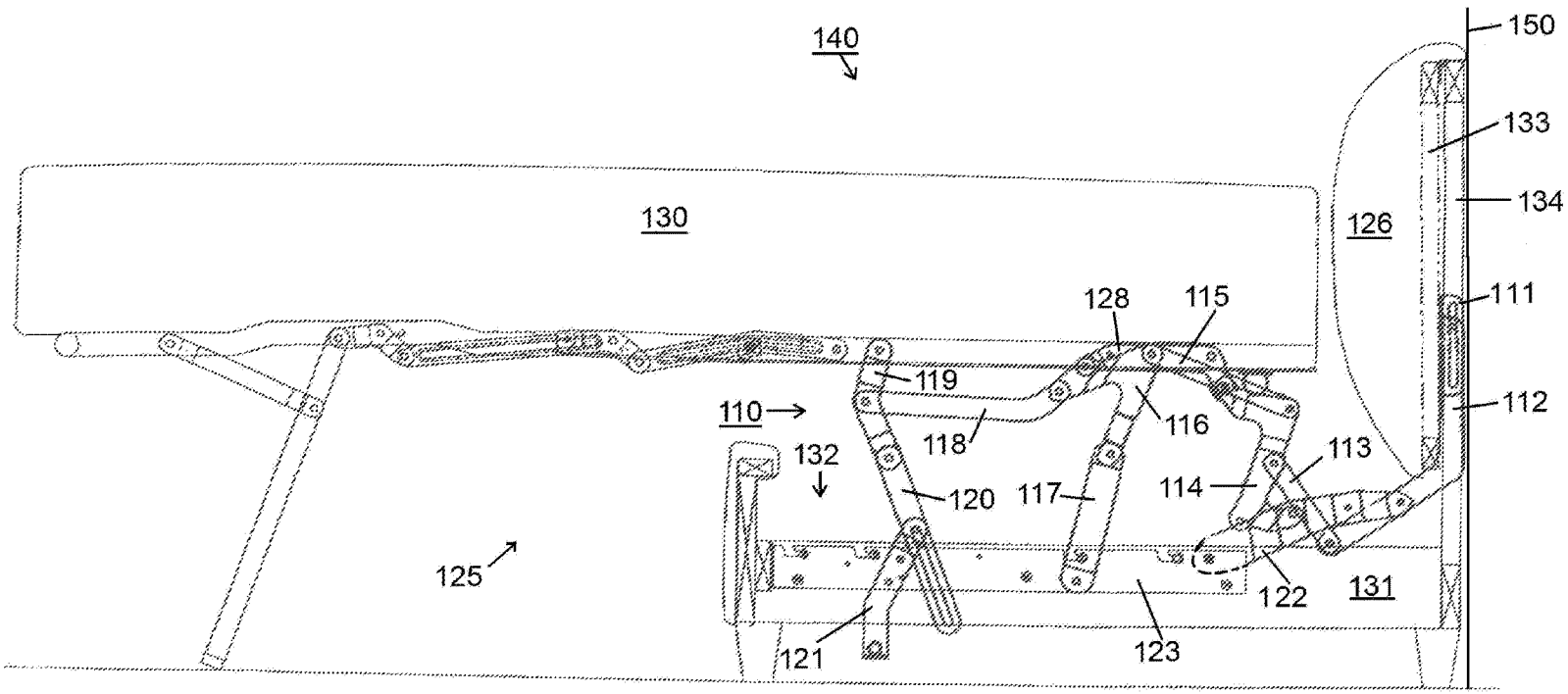
FIG. 11 illustrates a side plan view of the foldable bed assembly of FIG. 10.
Figure 12:
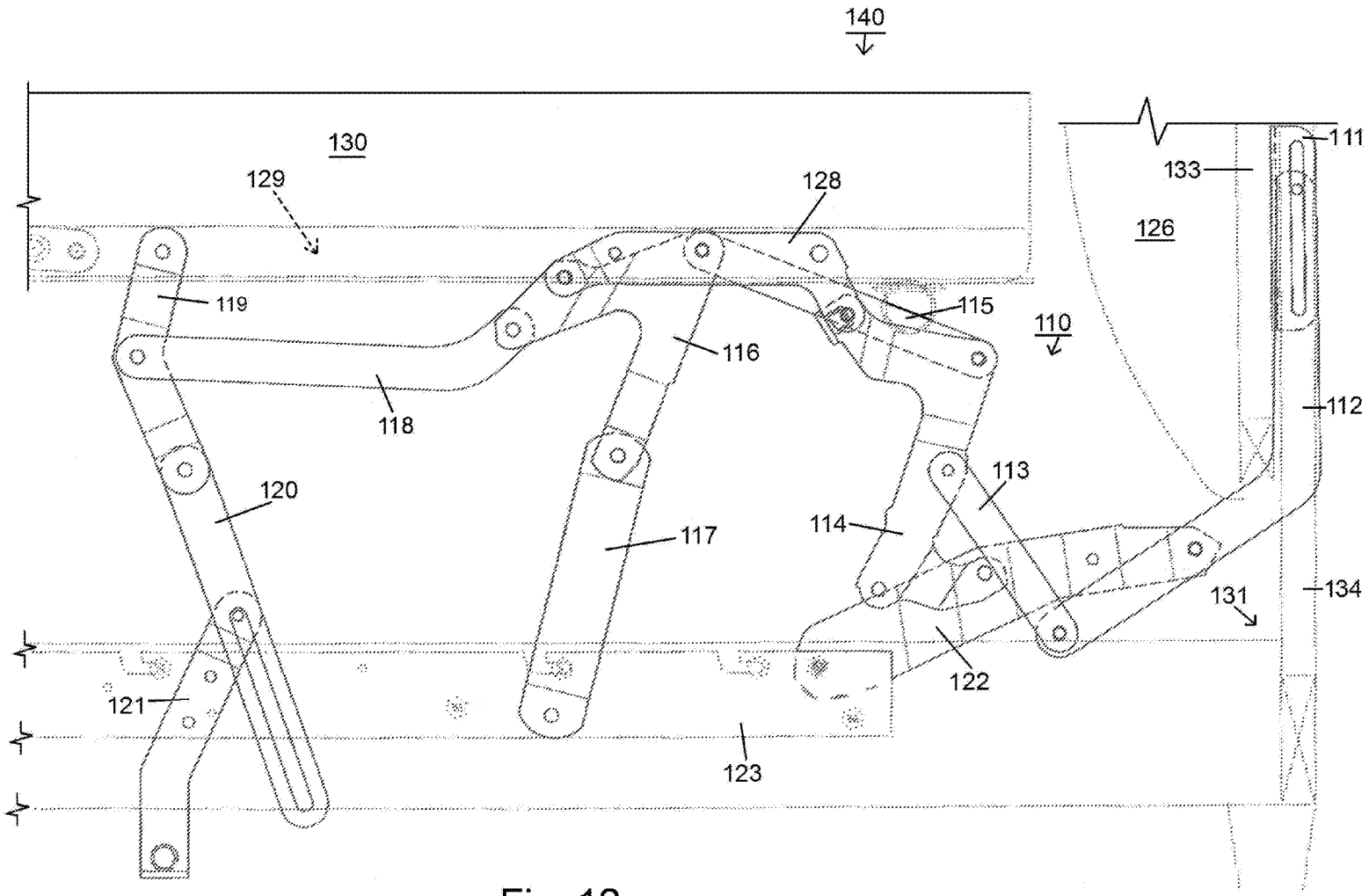
FIG. 12 features an enlarged side plan view of the foldable bed assembly of FIG. 11.

In FIGS. 11 and 12, seat cushion 127 has been removed and foldable linkage 110 is fully extended with mattress 130 removed from cavity 132 and unfolded for sleeping or resting purposes. Mattress 130 rests on mattress frame 129. Frame link 128 is rigidly affixed to mattress frame 129 and pivotally affixed to Z-shaped link 114 and V-link 116 of foldable linkage 110. During the transition from a sofa to a bed, back cushion support 133 has moved from an angled position as seen in FIG. 7 to a vertical position as shown in FIG. 11 parallel with headboard 134 positioned against wall 150. As demonstrated in FIGS. 11 and 12, slotted link 111 and a portion of first arcuate link 112 are also parallel with and overlap headboard 134 when bed assembly 140 is fully extended.

Thus as shown and described, foldable bed assembly 140 can be placed with headboard 134 against wall 150 or similar structure with foldable linkage 110 within cavity 132. When desired, mattress 130 can be unfolded for opening sofa bed 125 as seen in FIG. 11 while vertical headboard 134 remains directly against a wall or other structure (not shown). This provides advantages for use in small rooms and otherwise to prevent the necessity of sofa bed 125 having to be urged from a wall during the extension and folding processes.

The illustrations and examples provided herein are for explanatory purposes and are not intended to limit the scope of the appended claims. Many of the links that make up the instant invention are identified with terms which suggest their shape, but these terms are not intended to limit the shape of the contemplated member or the configuration with which the links engage one another. The links defining offsets and bends are likewise intended to be construed as allowing offsets and bends in any and all directions spatially permitted within sofa 11. All of the links as described are preferably formed out of metal, although other materials such as wood or polymeric materials are also contemplated.

I claim:

1. A bed assembly comprising a foldable bed frame pivotably connected to a sofa back support via a linkage, such that the sofa back support is configured to automatically pivot via the linkage from a substantially vertical first position to the angularly oriented second position when the bed frame transitions from an extended position to a stored position, and the angularly oriented second position to the substantially vertical first position when the bed assembly transitions from the stored position to the extended position, said linkage comprising, a first slotted link defining a slot, said first slotted link affixed to said sofa back support;

an adjustment link defining at least two portions, said first adjustment link portion slideably attached to said first slotted link, said second adjustment link portion in pivotable communication with a linking link;

a first link attached to said bed frame and a joining link, the joining link rotatably connected to both a coupling link and a first planar link, said coupling link attached to a base member mounted to the sofa;

whereby said first adjustment link portion defines a substantially vertical orientation in a first position when said bed frame is in an extended position, whereby said first adjustment link portion travels a linear distance within said slot to define a substantially horizontal orientation in a second position relative to said first position when said bed frame is in a stored position; and whereby the attachment, orientation, and rotation of said first slotted link, said adjustment link, said first planar link, and said joining link result in a sofa back support that is configured to pivot automatically from the substantially vertical first position to the angularly oriented second position when the bed frame transitions from an extended position to a stored position, and the angularly oriented second position to the substantially vertical first position when the bed assembly transitions from the stored position to the extended position.

2. The linkage of claim 1 wherein said adjustment link defines an aperture.

3. The linkage of claim 1 wherein said adjustment link is L-shaped.

4. The linkage of claim 1 wherein said first slotted link slot defines a longitudinally extending slot.

5. The linkage of claim 1 wherein said first link defines a plurality of longitudinally extended slots.

6. The linkage of claim 1 further comprising a first L-shaped link, a second L-shaped link, a biasing member, said first L-shaped link attached to said base member, said biasing member attached to said first and second L-shaped links.

7. The linkage of claim 1 whereby said joining link defines a V-shape, is connected to said base member, and is in pivotable communication with said first link.

8. The linkage of claim 1 further comprising a first U-shaped link, said first U-shaped link attached to said first link.

9. The linkage of claim 8 further comprising a first arcuate link and a second arcuate link, said first arcuate link connected to said first U-shaped link, said second arcuate link affixed to said bed frame and said first arcuate link.

10. A bed assembly comprising a foldable bed frame including a support leg pivotally attached thereto, said bed frame pivotably connected to a sofa back support via a linkage, such that the sofa back support is configured to automatically pivot via the linkage from a substantially vertical first position to the angularly oriented second position when the bed frame transitions from an extended position to a stored position, and the angularly oriented second position to the substantially vertical first position when the bed assembly transitions from the stored position to the extended position, said linkage comprising, a first slotted link defining a slot, said first slotted link affixed to said sofa back support;

an adjustment link defining two portions, said first adjustment link portion in direct slideable communication with said first slotted link via an attachment link, said second adjustment link portion in direct pivotable communication with a linking link;

a first link attached to said bed frame and a joining link, the joining link rotatably connected to both a coupling link and a first planar link, said coupling link attached to a base member mounted to the sofa;

whereby said first adjustment link portion and said attachment link define a substantially vertical orientation in a first position when said bed frame is in an extended position, whereby said first adjustment link portion via said attachment link travel a linear distance within said slot to define a substantially horizontal orientation in a second position relative to said first position when said bed frame is in a stored position; and whereby the attachment, orientation, and rotation of said first slotted link, said adjustment link, said attachment link, said first planar link, and said joining link result in a sofa back support that is configured to pivot automatically from the substantially vertical first position to the angularly oriented second position when the bed frame transitions from an extended position to a stored position, and the angularly oriented second position to the substantially vertical first position when the bed assembly transitions from the stored position to the extended position.

11. The linkage of claim 10 wherein said adjustment link is L-shaped, said adjustment link defining a plurality of apertures.

12. The linkage of claim 11 wherein said first slotted link slot defines a longitudinally extending slot.

13. The linkage of claim 11 whereby said base member defines a slot.

14. The linkage of claim 13 further comprising a first L-shaped link, a second L-shaped link, a biasing member, said biasing member attached to said first and second L-shaped links, a second slotted link and a third slotted link, said first and second L-shaped links and said third slotted links connected to said base member.

15. The linkage of claim 14 whereby said joining link defines a V-shape, is connected to said base member and said second slotted link.

16. The linkage of claim 14 further comprising a first U-shaped link, a second U-shaped link, said first and second U-shaped links connected to said second slotted link, whereby said second slotted link defines a pair of slots.

17. The linkage of claim 16 further comprising a second arcuate link and a third arcuate link, said second arcuate link connected to said first U-shaped link, said third arcuate link affixed to said bed frame and said second arcuate link, and whereby said first link defines an arcuate shape and is attached to said coupling link and said second slotted link.

* * * * *